US006811343B1

(12) United States Patent
Yang

(10) Patent No.: US 6,811,343 B1
(45) Date of Patent: Nov. 2, 2004

(54) LOOSE-LEAF TYPE STORAGE DEVICE

(75) Inventor: Qinghao Yang, New Providence (BS)

(73) Assignee: Global Industries Holdings, Ltd., Nassau (BS)

( * ) Notice: Subject to any disclaimer, the term of this patent is extended or adjusted under 35 U.S.C. 154(b) by 0 days.

(21) Appl. No.: 10/680,055

(22) Filed: Oct. 6, 2003

(30) Foreign Application Priority Data

Jul. 17, 2003 (TW) ..... 92213083 U

(51) Int. Cl.[7] ..... B42F 13/00; B42F 17/00; B65D 73/00

(52) U.S. Cl. ..... 402/73; 402/75; 40/390; 40/492; 206/472; 16/334; 16/365

(58) Field of Search ..... 402/73, 74, 75, 402/76, 77, 78, 27, 28; 412/17; 206/472, 449, 450, 451, 452, 503–505, 509, 759, 45.23; 359/447; 40/377, 388, 390, 492; 16/334, 337, 342, 365

(56) References Cited

U.S. PATENT DOCUMENTS 2,505,116 A * 4/1950 Hitchings ..... 40/390
5,375,936 A * 12/1994 Jennison et al. ..... 402/73
5,562,208 A * 10/1996 Hasler et al. ..... 206/373
5,751,477 A * 5/1998 Tomita et al. ..... 359/447
6,296,127 B1 * 10/2001 Tseng ..... 211/45
2004/0027661 A1 * 2/2004 Sherman ..... 359/447

FOREIGN PATENT DOCUMENTS

CA 2444547 A1 * 3/2004 ..... B42C/7/00
GB 2294241 A * 4/1996 ..... B43L/13/00

* cited by examiner

*Primary Examiner*—Derris H. Banks
*Assistant Examiner*—Ali Abdelwahed
(74) *Attorney, Agent, or Firm*—Leon I. Edelson; Levenfeld Pearlstein

(57) ABSTRACT

A loose-leaf type storage device includes a pivot shaft (20), a plurality of storage cases, each storage case having a plurality of barrels axially aligned in a line at one side and respectively coupled to the pivot shaft, and a loose-leaf positioning structure provided between the pivot shaft and the storage cases for enabling the storage cases to be turned about the pivot shaft and selectively positioned in one of a series of angles.

10 Claims, 9 Drawing Sheets

LOOSE-LEAF TYPE STORAGE DEVICE

OF THE INVENTION

1. Field of the Invention

The present invention relates to a storage device for keeping accessories and, more specifically to a loose-leaf type storage device, which is comprised of a plurality of storage cases pivotally coupled to a cotton shaft.

2. Description of the Related Art

An accessories storage case is a case-like container comprising a plurality of storage chambers of different sizes for keeping accessories, and a plurality of hinged lids adapted to close the storage chambers respectively. A number of storage cases may be installed in a cabinet or rack for keeping a big amount of different accessories. There is also known a storage case comprised of a plurality of cases that can be set into a stack, or extended out. The main drawback of conventional storage cases is that the user can not conveniently visually check all storage items at a glance. Further conventional storage cases are specifically designed to be put on a flat surface when arranging the storage items. Putting these storage cases in vertical or hanging these storage cases on a wall may cause storage items to fall to the ground.

SUMMARY OF THE INVENTION

The present invention has been accomplished under the circumstances in view. It is the main object of the present invention to provide a loose-leaf storage device, which can be selectively placed on a flat surface in horizontal, supported on a stand in vertical, or hung on a wall. It is another object of the present invention to provide a loose-leaf storage device, which has the storage cases thereof turnable relative to one another and respectively set in one of a series of angles.

To achieve these and other objects of the present invention, the loose-leaf type storage device comprises a plurality of storage cases, the storage cases each comprising a plurality of barrels axially aligned in a line at one side; a pivot shaft inserted through the barrels of the storage cases for enabling the storage cases to be respectively turned about the pivot shaft, the pivot shaft having a hollow head disposed at a first end thereof and stopped at one end of the aligned barrels and an end cap fastened to a second end thereof and stopped at an opposite end of the aligned barrels; and a loose-leaf positioning structure provided between the pivot shaft and the storage cases for enabling the storage cases to be turned about the pivot shaft and selectively positioned in one of a series of angles, the loose-leaf positioning structure comprising a plurality of spring leaves respectively formed integral with the pivot shaft and longitudinally aligned in a line, the spring leaves each having a free end provided with a raised engagement portion, and a plurality of locating grooves respectively formed inside the barrels for engagement with the raised engagement portions of the spring leaves.

DETAILED DESCRIPTION OF THE PREFERRED EMBODIMENT

Figure 1:
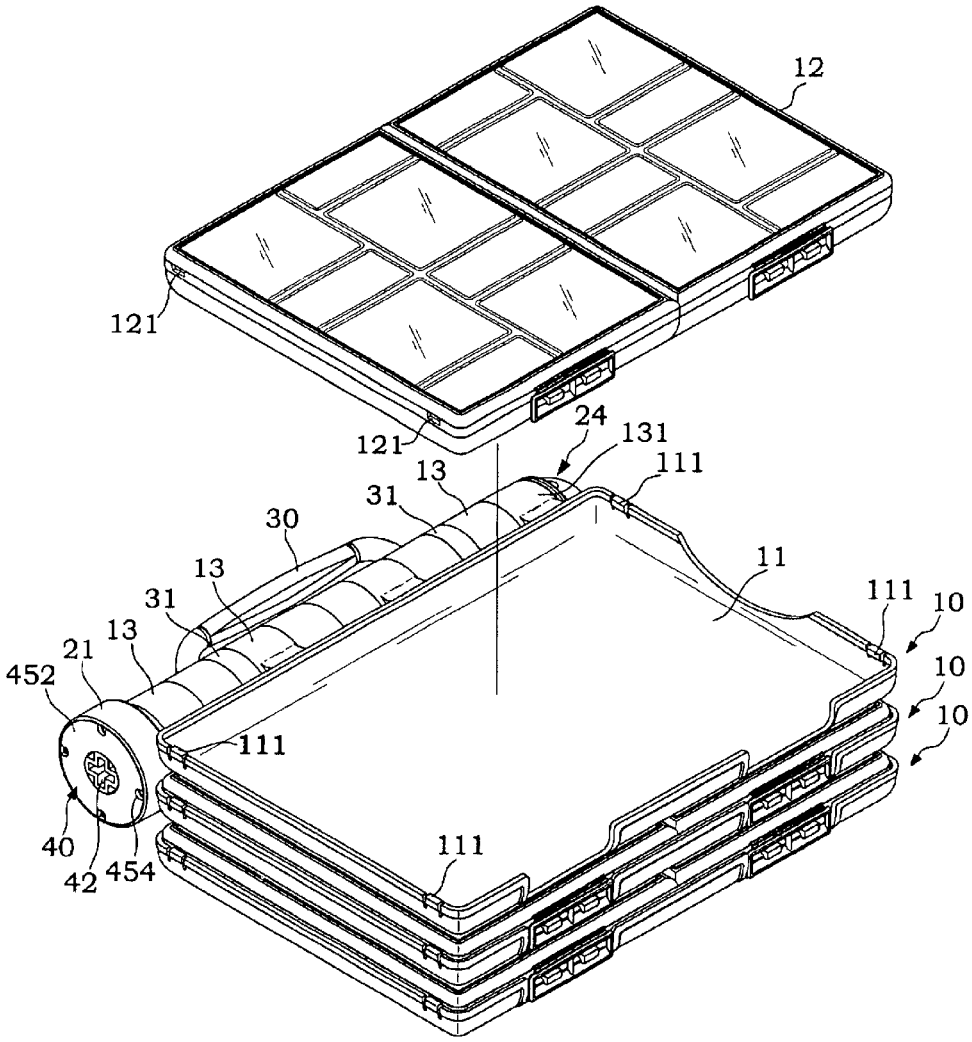
FIG. 1 is an exploded view of a loose-leaf type storage device according to the present invention.
Figure 2:
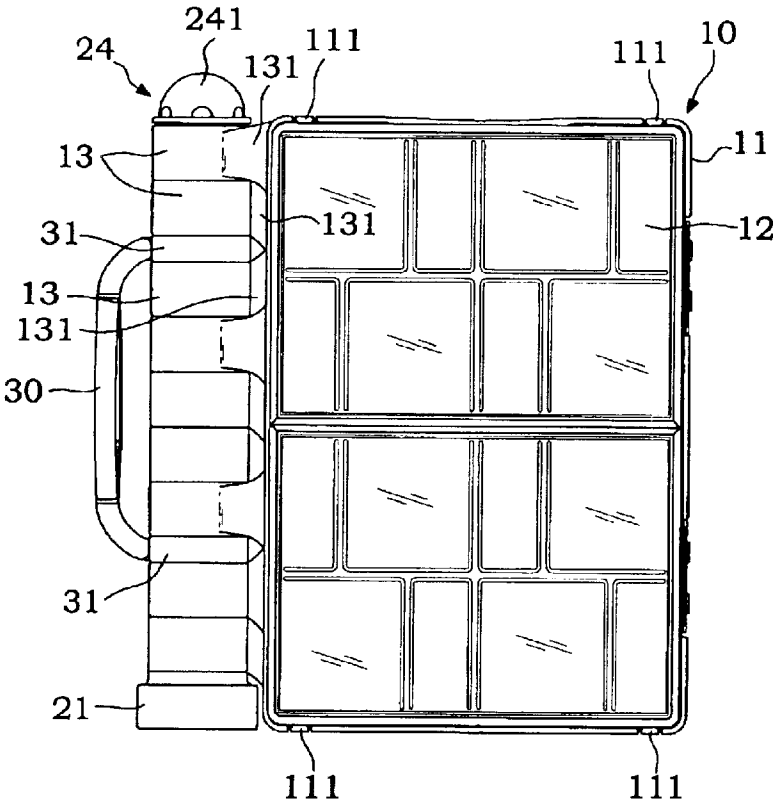
FIG. 2 is a front plain view of the loose-leaf type storage device according to the present invention.
Figure 6:
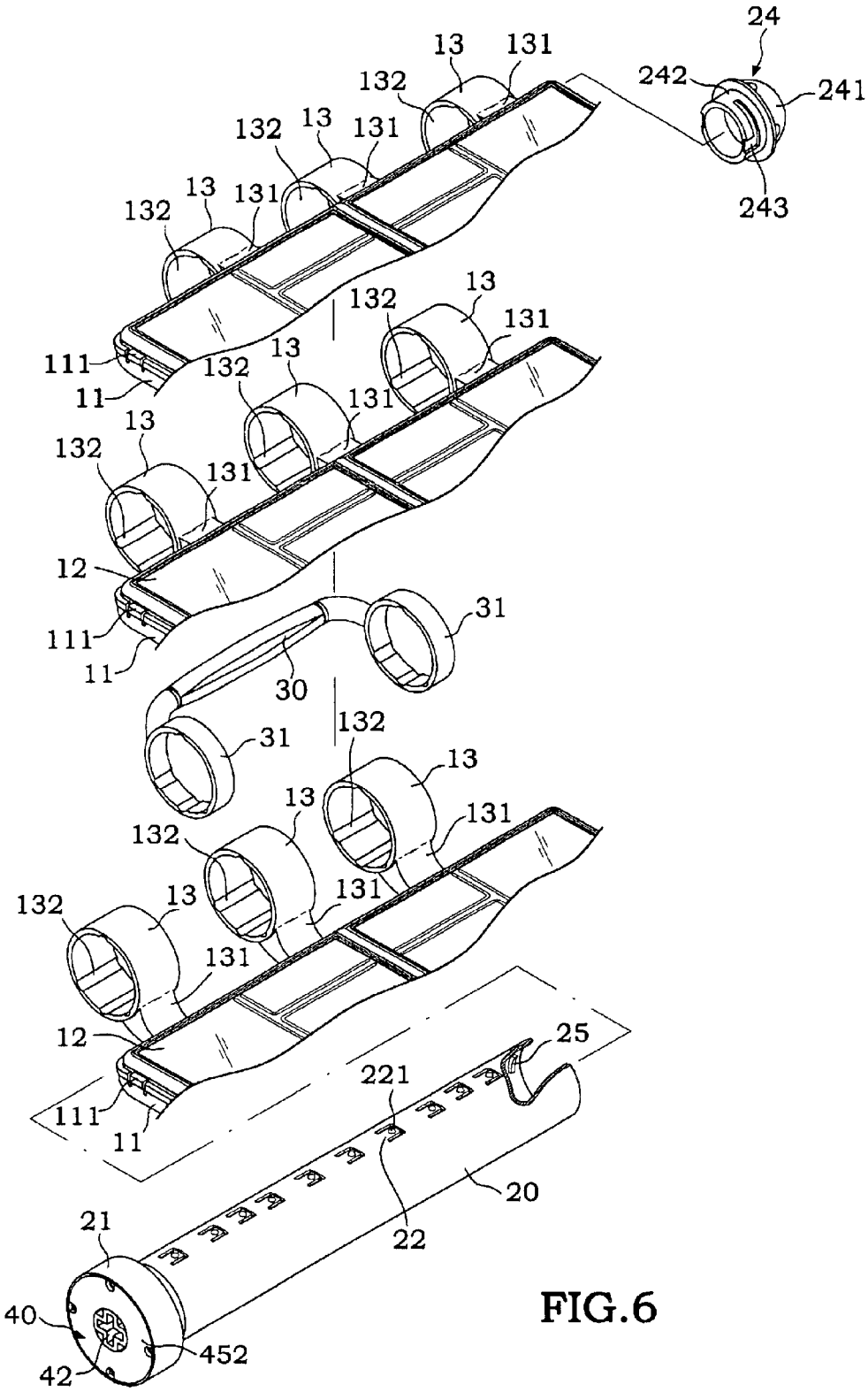
FIG. 6 is an exploded view in an enlarged scale of a part of the loose-leaf storage device according to the present invention.

Referring to FIGS. 1, 2, and 6, a loose-leaf type storage device is shown comprised of a pivot shaft 20, and a plurality of flat rectangular storage cases 10. Each flat rectangular storage case 10 comprises a flat rectangular tray 11 and a flat rectangular case 12. The tray 11 and the case 12 are respectively molded from plastics. The tray 11 is adapted to accommodate the case 12. The case 12 defines a plurality of storage compartments respectively covered with a respective transparent plastic lid. A positioning structure is provided between the tray 11 and the case 12 so that the case 12 can be positively held in position when put in the tray 11. The tray 11 comprises a plurality of projecting strips 131 aligned at one long side, and a plurality of barrels 13 respectively formed integral with the projecting strips 131 and aligned in a line. The projecting strips 131 of the trays 11 of the flat rectangular storage cases 10 are so arranged that the barrels 13 of the trays 11 of the flat rectangular storage cases 10 are aligned in a line for the insertion of the pivot shaft 20. The pivot shaft 20 is inserted through the barrels 13 of the trays 11 of the flat rectangular storage cases 10, having a hollow head 21 disposed at one end, namely, the first and stopped at one end of the aligned barrels 13 of the trays 11 of the flat rectangular storage cases 10 and the other end, namely, the second end extended out of the other end of the aligned barrels 13 of the trays 11 of the flat rectangular storage cases 10 and mounted with an end cap 24, which is stopped at the other end of the aligned barrels 13 of the trays 11 of the flat rectangular storage cases 10. After installation of the pivot shaft 20 in the aligned barrels 13 of the trays 11 of the flat rectangular storage cases 10, the trays 11 can be respectively turned about the pivot shaft 20.

There is a loose-leaf (tray) positioning structure provided between the pivot shaft 20 and the trays 11 of the flat rectangular storage cases 10. As illustrated in FIGS. 1 and 6, the loose-leaf positioning structure comprises a plurality of spring leaves 22 respectively formed integral with the pivot shaft 20 and longitudinally aligned in a line, each spring leaf 22 having a raised engagement portion 221 at the free end, and a plurality of locating grooves 132 respectively formed inside the barrels 13. When turning one tray 11 about the pivot shaft 20 to a particular angle, the locating grooves 132 of the barrels 13 of the tray 11 are forced into engagement with the raised engagement portions 221 of the corresponding spring leaves 22 at the pivot shaft 20, and therefore the tray 11 is locked in position. By applying a biasing force to the tray 11, the locating grooves 132 of the barrels 13 of the tray 11 are disengaged from the raised engagement portions 221 of the corresponding spring leaves 22 at the pivot shaft 20.

Figure 5A:
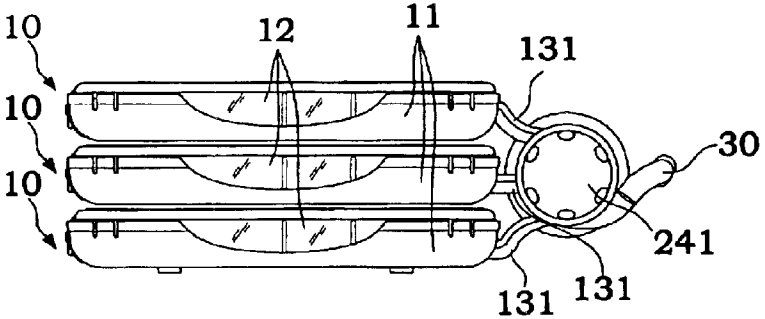
FIG. 5A is an end plain view of the loose-leaf type storage device according to the present invention.
Figure 4:
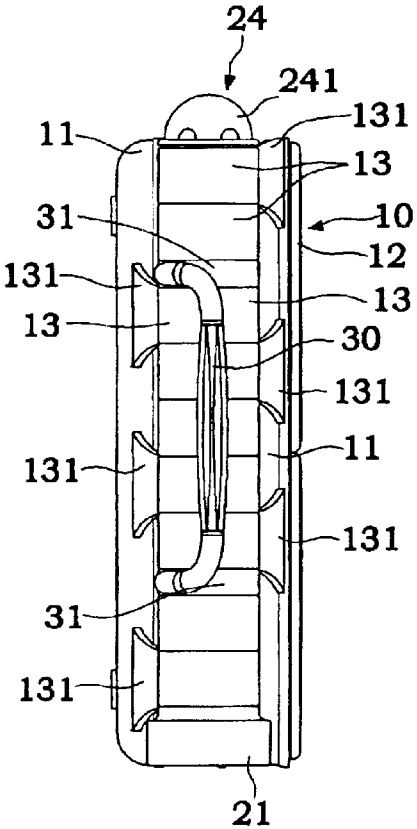
FIG. 4 is a left plain view of the loose-leaf type storage device according to the present invention.
Figure 5B:
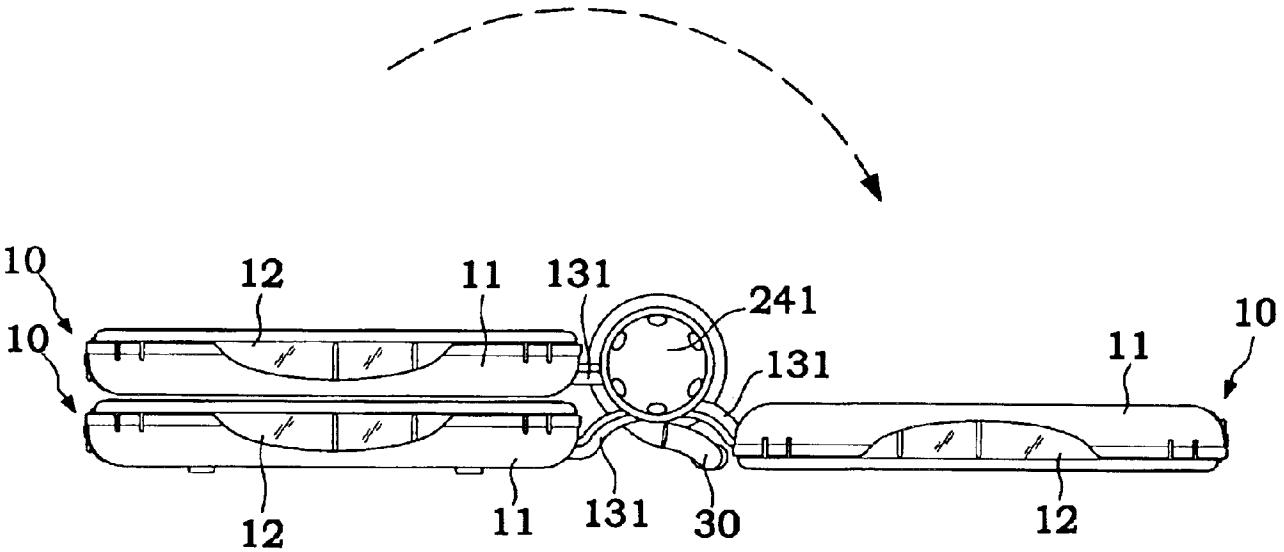
FIG. 5B is schematic end view of the present invention showing an adjustment example of the angular positions of the storage cases.
Figure 5C:
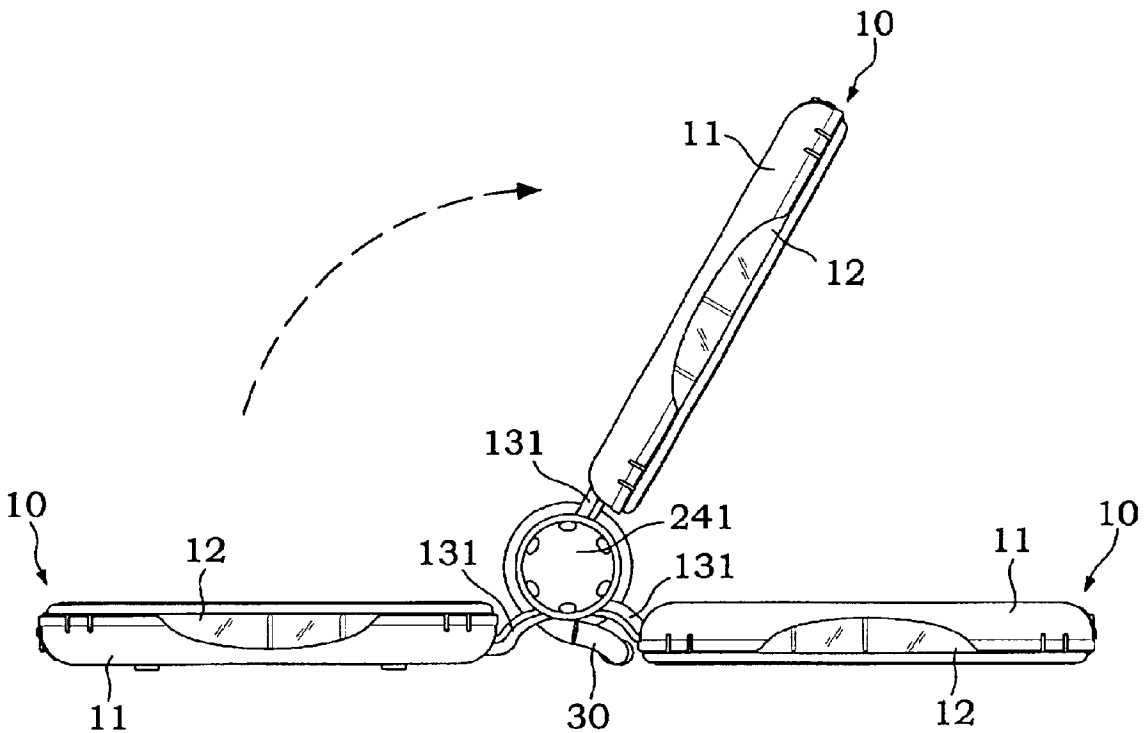
FIG. 5C is schematic end view of the present invention, showing another adjustment example of the angular positions of the storage cases.

Referring to FIGS. 5A, 5B, and 5C, after loading of the cases 12 in the trays 11, the storage cases 10 can be arranged in a stack (see FIG. 5A), or turned about the pivot shaft 20 relative to one another to the desired angle (see FIGS. 5B and 5C).

There is also provided a positioning structure adapted to lock the case 12 to the corresponding tray 11. The positioning structure comprises a plurality of springy hooks 111 respectively formed integral with the peripheral wall of the tray 11, and a plurality of retaining grooves 121 respectively disposed at the peripheral wall of the case 12 and adapted to receive the springy hooks 111 at the tray 11.

Referring to FIGS. 1 and 6 again, a handle 30 is provided having two barrels 31 extended from the two distal ends and respectively coupled to the pivot shaft 20. Through the handle 30, the user can conveniently carry the loose-leaf type storage device by hand.

Referring to FIG. 6 again, the aforesaid end cap 24 comprises a semispherical head 241, a plug portion 242 insertable into the second end (the end remote from the head 21) of the pivot shaft 20, and an angled locating slot 253 formed in the plug portion 242. The pivot shaft 20 has a projecting block 25 disposed inside the second end. During installation, the angled locating slot 253 is aimed at the projecting block 25, and then the plug portion 242 of the end cap 24 is plugged into the second end of the pivot shaft 20, and then the end cap 24 is rotated through an angle relative to the pivot shaft 20, and thus the end cap 24 is locked to the pivot shaft 20 and prohibited from axial movement relative to the pivot shaft 20.

Figure 7:
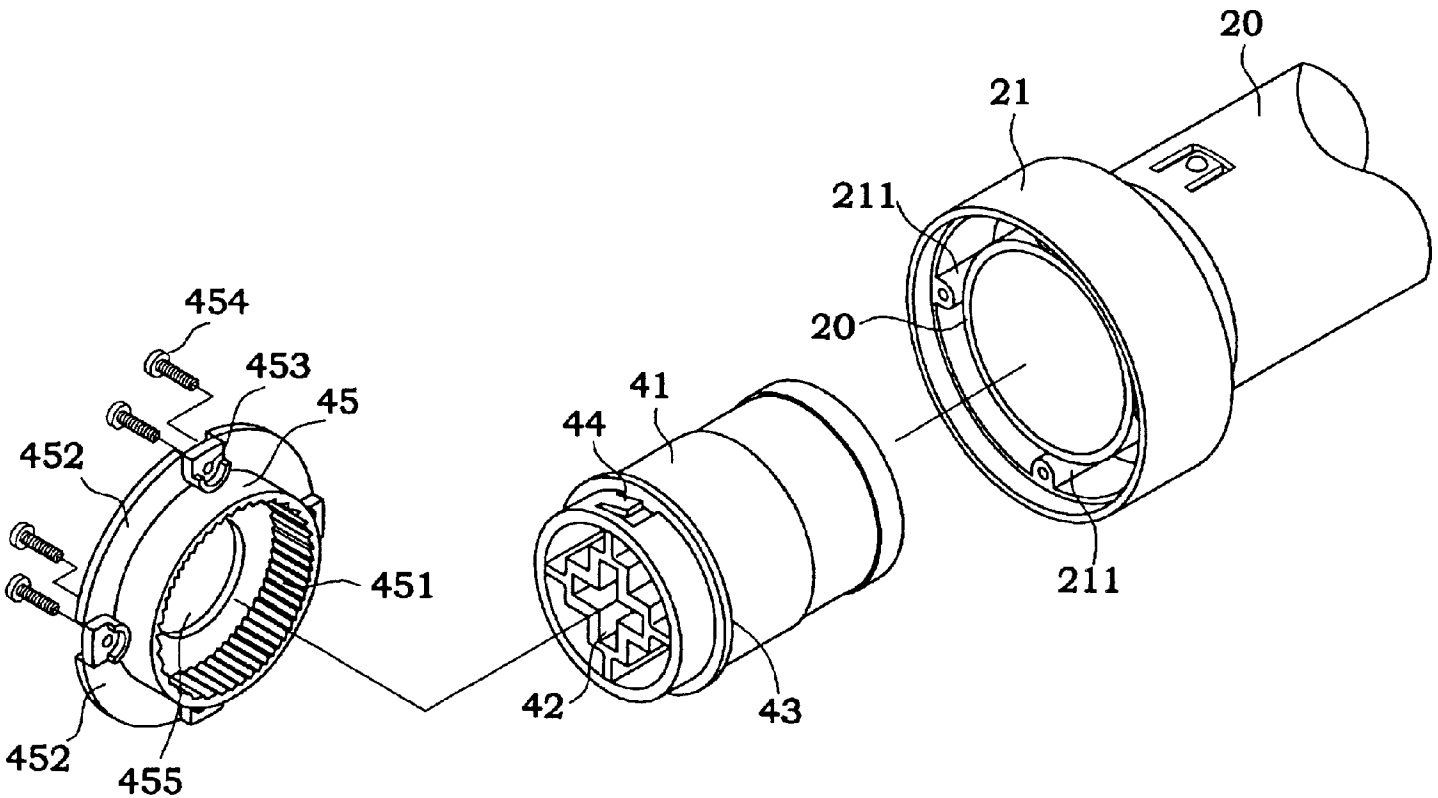
FIG. 7 is an exploded view in an enlarged scale of the rotary anchoring structure of the loose-leaf type storage device according to the present invention.
Figure 8:
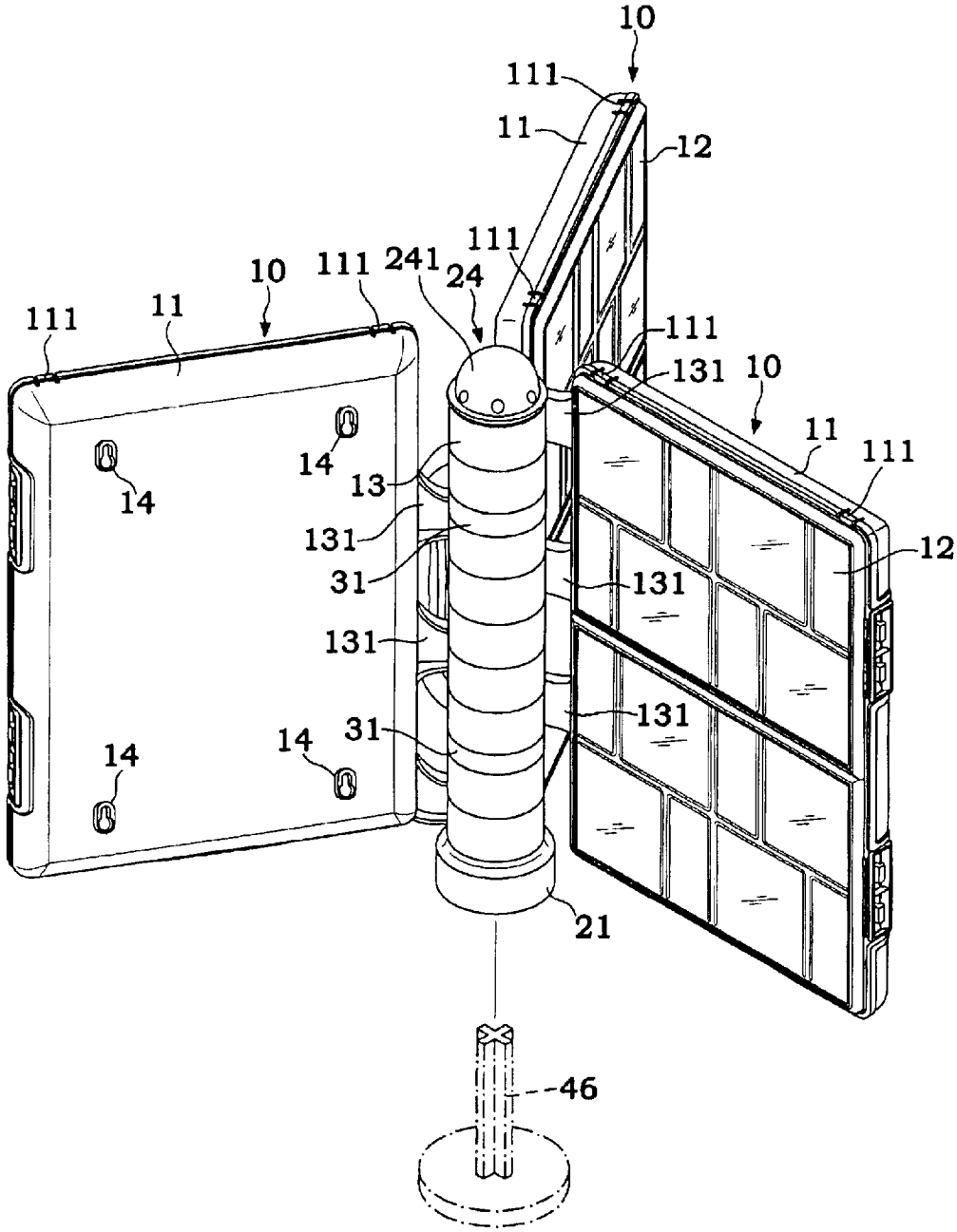
FIG. 8 is an exploded view showing the use of the loose-leaf type storage device with a stand.

Referring to FIGS. 6~8, a rotary anchoring structure 40 is provided comprising a plurality of female screws 221 respectively axially disposed inside the hollow head 21 of the pivot shaft 20, a cylindrical block 41 inserted into the hollow head 21, the cylindrical block 41 having a peripheral stop flange 43 stopped outside the hollow head 21 of the pivot shaft 20, a non-circular plug hole, for example, crossed plug hole 42 axially disposed at the center, and a springy pawl 44 projecting from the periphery outside the hollow head 21 of the pivot shaft 20, a ratchet cap 45 capped on the cylindrical block 41, the ratchet cap 45 comprises a ratchet 451 meshed with the springy pawl 44, an outward peripheral flange 452 stopped outside the hollow head 21 of the pivot shaft 20, a plurality of screw holes 453 disposed at the outward peripheral flange 451 and respectively connected to the female screws 221 inside the hollow head 21 of the pivot shaft 20 by screws 454, and a center through hole 455 axially disposed at the center and aimed at the crossed plug hole 42. A crossed-shaft stand 46 is inserted through the center through hole 455 and plugged into the crossed plug hole 42 to support the loose-leaf type storage device on a flat surface in vertical. When installed, the storage cases 10 can be turned with the pivot shaft 20 and the ratchet cap 45 relative to the cylindrical block 41 and the crossed-shaft stand 46 in one direction through 360°.

Figure 3:
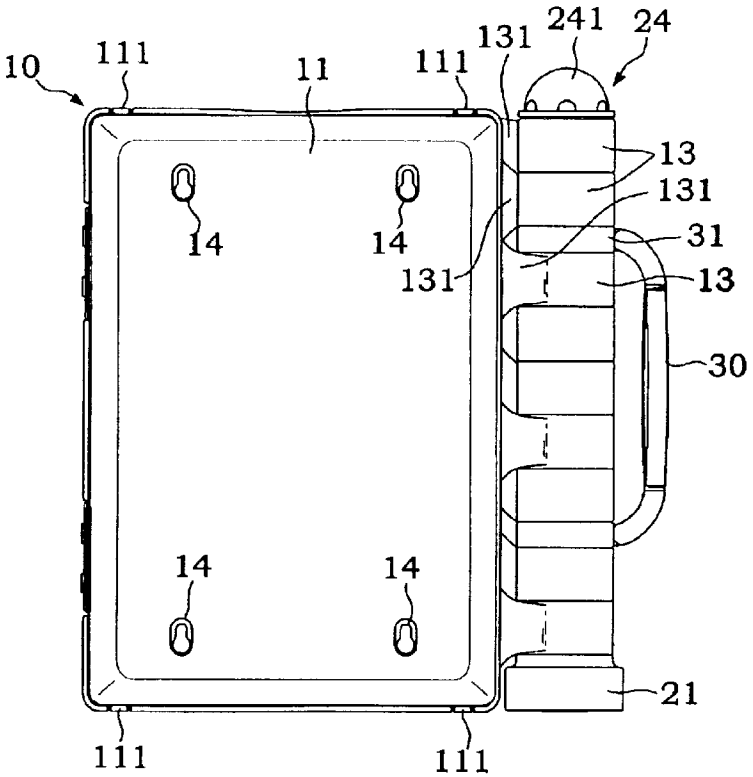
FIG. 3 is a rear plain view of the loose-leaf type storage device according to the present invention.

Referring to FIG. 3, the trays 11 of the storage cases 10 each have a plurality of hang holes 14 for hanging on wall nails or the like.

As indicated above, the loose-leaf type storage device can be horizontally placed on a flat surface, or set in vertical and supported on a stand by means of the rotary anchoring structure 40, or hang on a wall by means of the hanging holes 14 at the trays 11.

When placed on a flat surface, set in vertical, or hung on a wall, the storage cases 10 can be respectively turned about the pivot shaft 10 relative to one another and then positioned in any of a series of angles by means of the engagement between the raised engagement portions 221 of the spring leaves 22 and the locating grooves 132 of the barrels 13 for convenient arrangement of storage items in the cases 12. Through the handle 30, the user can conveniently carry the loose-leaf type storage device by hand.

A prototype of loose-leaf type storage device has been constructed with the features of FIGS. 1~8. The loose-leaf type storage rack functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A loose-leaf type storage device comprising a plurality of storage cases, said storage cases each comprising a plurality of barrels axially aligned in a line at one side;

a pivot shaft inserted through the barrels of said storage cases for enabling said storage cases to be respectively turned about said pivot shaft, said pivot shaft having a hollow head disposed at a first end thereof and stopped at one end of said aligned barrels and an end cap fastened to a second end thereof and stopped at an opposite end of said aligned barrels; and a loose-leaf positioning structure provided between said pivot shaft and said storage cases for enabling said storage cases to be turned about said pivot shaft and selectively positioned in one of a series of angles, said loose-leaf positioning structure comprising a plurality of spring leaves respectively formed integral with said pivot shaft and longitudinally aligned in a line, said spring leaves each having a free end provided with a raised engagement portion, and a plurality of locating grooves respectively formed inside said barrels for engagement with the raised engagement portions of said spring leaves.

2. The loose-leaf type storage device as claimed in claim 1, wherein said storage cases each comprise a case and a tray adapted to accommodate the case.

3. The loose-leaf type storage device as claimed in claim 2, wherein said storage cases each further comprise a tray positioning structure adapted to lock the cases of said storage cases to the corresponding trays, said tray positioning structure comprising a plurality of springy hooks respectively formed integral with a peripheral wall of the tray of each of said storage cases, and a plurality of retaining grooves respectively disposed at a peripheral wall of the case of each of said storage cases and adapted to receive said springy hooks.

4. The loose-leaf type storage device as claimed in claim 2, wherein said trays of said storage cases each comprise a plurality of projecting strips aligned at one side, and said barrels are respectively formed integral with said projecting strips of said trays.

5. The loose-leaf type storage device as claimed in claim 1, further comprising a handle connected to a middle part of said pivot shaft for carrying.

6. The loose-leaf type storage device as claimed in claim 5, wherein said handle comprises two barrels disposed at two ends thereof and respectively coupled to said pivot shaft.

7. The loose-leaf type storage device as claimed in claim 1, wherein said end cap comprises a semispherical head, a plug portion inserted into the second end of said pivot shaft, and an angled locating slot formed in said plug portion; said pivot shaft has a projecting block disposed inside said second end and inserted into said angled locating slot and adapted to lock said end cap to said pivot shaft upon a rotary motion of said end cap relative to said pivot shaft.

8. The loose-leaf type storage device as claimed in claim 1, further comprising a rotary anchoring structure, said rotary anchoring structure comprising a cylindrical block inserted into said hollow head of said pivot shaft, said cylindrical block having a peripheral stop flange stopped outside said hollow head of said pivot shaft, a non-circular plug hole axially disposed at a center, and a springy pawl projecting from a periphery thereof outside said hollow head of said pivot shaft, a ratchet cap capped on said cylindrical block, said ratchet cap comprises a ratchet meshed with said springy pawl, and a center through hole axially disposed at the center and aimed at said non-circular plug hole through which a stand means is inserted and plugged into said non-circular plug hole to support the loose-leaf type storage device on a flat surface in a vertical orientation.

9. The loose-leaf type storage device as claimed in claim 8, wherein said rotary anchoring structure further comprises a plurality of female screws formed inside said hollow head of said pivot shaft, an outward peripheral flange formed integral with a periphery of said ratchet cap, and a plurality of screw holes disposed at said outward peripheral flange and respectively connected to said female screws inside said hollow head of said pivot shaft by screws.

10. The loose-leaf type storage device as claimed in claim 1, further comprising a hanging structure, said hanging structure comprising a plurality of hanging holes formed in said storage cases for hanging.

* * * * *